US009580831B2

(12) United States Patent
Glass et al.

(10) Patent No.: US 9,580,831 B2
(45) Date of Patent: Feb. 28, 2017

(54) STAINLESS STEEL PICKLING IN AN OXIDIZING, ELECTROLYTIC ACID BATH

(71) Applicant: AK Steel Properties, Inc., West Chester, OH (US)

(72) Inventors: Amanda R. Glass, Springboro, OH (US); Ronald D. Rodabaugh, Fiarborn, OH (US); David M. Price, Crown Point, IN (US)

(73) Assignee: AK Steel Properties, Inc., West Chester, OH (US)

( * ) Notice: Subject to any disclaimer, the term of this patent is extended or adjusted under 35 U.S.C. 154(b) by 701 days.

(21) Appl. No.: 13/627,022

(22) Filed: Sep. 26, 2012

(65) Prior Publication Data

US 2013/0074871 A1 Mar. 28, 2013

Related U.S. Application Data

(60) Provisional application No. 61/539,259, filed on Sep. 26, 2011.

(51) Int. Cl.

| | |
|---|---|
| ***C23G 1/02*** | (2006.01) |
| ***C25F 1/06*** | (2006.01) |
| *C23G 1/08* | (2006.01) |
| *B08B 3/00* | (2006.01) |
| *B08B 3/04* | (2006.01) |

(52) U.S. Cl.

CPC *C25F 1/06* (2013.01); *B08B 3/00* (2013.01); *B08B 3/04* (2013.01); *C23G 1/081* (2013.01); *C23G 1/085* (2013.01); *C23G 1/086* (2013.01)

(58) Field of Classification Search

CPC ..... C23G 1/081; C23G 1/086; C23G 1/085; B08B 3/00; B08B 3/04

See application file for complete search history.

(56) References Cited

U.S. PATENT DOCUMENTS 2,347,742 A * 5/1944 Keene ..... C25F 1/14 134/27
3,043,758 A * 7/1962 Machu ..... C23G 1/08 134/27
3,622,478 A 11/1971 Beyer
4,618,379 A * 10/1986 Bruno et al. ..... 148/623

(Continued)

FOREIGN PATENT DOCUMENTS

AU 2012316187 B2 9/2015
CN 1615377 A 5/2005

(Continued)

OTHER PUBLICATIONS

International Search Report and Written Opinion dated Feb. 7, 2013 for Application No. PCT/US2012/057191.

(Continued)

*Primary Examiner* — Bibi Carrillo
(74) *Attorney, Agent, or Firm* — Frost Brown Todd LLC

(57) ABSTRACT

A pickling process designed for pickling a metal strip such as a stainless steel strip reduces the amount of HF and/or $HNO_3$. The strip is immersed in at least one first pickling tub that contains a mixture of an acid such as $H_2SO_4$, an excess of at least one oxidizing agent, and includes electrodes that may apply a current to the strip that runs through the mixture.

25 Claims, 2 Drawing Sheets

(56) References Cited

U.S. PATENT DOCUMENTS

| | | | | |
|---|---|---|---|---|
| 4,711,707 | A | 12/1987 | Kikuchi et al. | |
| 5,175,502 | A * | 12/1992 | Rodabaugh | C23G 1/02 134/10 |
| 5,364,549 | A * | 11/1994 | McDonogh | 252/79.4 |
| 5,743,968 | A * | 4/1998 | Leeker et al. | 134/2 |
| 5,879,465 | A * | 3/1999 | McKevitt et al. | 134/3 |
| 6,068,001 | A | 5/2000 | Pedrazzini et al. | |
| 6,210,558 | B1 | 4/2001 | Demertzis et al. | |
| 6,250,314 | B1 * | 6/2001 | Wasserbauer et al. | 134/3 |
| 6,274,027 | B1 * | 8/2001 | Kiya et al. | 205/705 |
| 6,398,876 | B1 * | 6/2002 | Starcevic et al. | 134/3 |
| 6,554,908 | B1 | 4/2003 | Negri et al. | |
| 6,599,371 | B2 | 7/2003 | Madi et al. | |
| 6,645,306 | B2 | 11/2003 | Madi et al. | |
| 7,799,199 | B2 | 9/2010 | Dulcetti et al. | |
| 8,128,754 | B2 | 3/2012 | Madi et al. | |
| 2006/0076247 | A1 * | 4/2006 | Giordani et al. | 205/705 |

FOREIGN PATENT DOCUMENTS

| | | | |
|---|---|---|---|
| CN | 101165223 | A | 4/2008 |
| EP | 582121 | | 2/1994 |
| JP | 2002-525429 | A | 8/2002 |
| JP | 5897717 | B2 | 3/2016 |
| KR | 10-0650961 | B1 | 11/2006 |
| RU | 2085616 | C1 | 7/1977 |
| RU | 2110618 | C1 | 5/1998 |
| SU | 1807098 | A1 | 4/1993 |
| TW | I452181 | B | 9/2014 |
| UA | 107061 | C2 | 11/2014 |
| WO | WO 97/43463 | | 11/1997 |
| WO | WO 99/32690 | | 7/1999 |
| WO | WO 02/086199 | | 10/2002 |
| WO | WO 03/052165 | | 6/2003 |

OTHER PUBLICATIONS

Australian Office Action dated Jun. 12, 2015 for Application No. AU 2012316187, 2 pgs.

Canadian Office Action dated Jul. 8, 2015 for Application No. CA 2,849,304, 2 pgs.

Chinese Office Action dated Nov. 2, 2015 for Application No. CN 201280046563.3, 13 pgs.

Chinese Office Action dated Apr. 5, 2016 for Application No. CN 201280046563.3, 17 pgs.

Japanese Office Action dated Feb. 24, 2015 for Application No. JP 2014-532100, 3 pgs.

Japanese Office Action dated Sep. 1, 2015 for Application No. JP 2014-532100, 3 pgs.

Korean Office Action dated Feb. 27, 2015 for Application No. KR 10-2014-7011318, 8 pgs.

Korean Office Action dated Oct. 26, 2015 for Application No. KR 10-2014-7011318, 6 pgs.

Russian Office Action dated 2015 for Application No. RU 2014113442/02(021000), 8 pgs.

Russian Office Action dated Jan. 29, 2016 for Application No. RU 2014113442/02(021000) 15 pgs.

Taiwanese Office Action dated Apr. 7, 2014 for Application No. TW 101135402, 11 pgs.

* cited by examiner

STAINLESS STEEL PICKLING IN AN OXIDIZING, ELECTROLYTIC ACID BATH

PRIORITY

This application claims priority to U.S. Provisional Patent Application Ser. No. 61/539,259, filed Sep. 26, 2011, entitled "STAINLESS STEEL PICKLING IN AN OXIDIZING, ELECTROLYTIC ACID BATH," the disclosure of which is incorporated by reference herein.

BACKGROUND

The annealing of a metal strip such as a stainless steel strip may result in the formation of oxides on the surface of the metal strip. These oxides are comprised of, for example, iron, chromium, nickel, and other associated metal oxides, and are removed or reduced prior to utilization of the strip. The oxides of stainless steel, however, can be resistant to the common acid treatments. In addition, these oxides adhere tightly to the base metal, and thus may require mechanical scale cracking such as shot blasting, roll bending, or leveling of the steel strip or electrolytic and/or molten salt bath treatment prior to pickling (removal of the oxides on the surface of the strip) to either loosen these oxides or make the oxide surface more porous before pickling the strip.

Traditionally, the oxides on the surface of the stainless steel have been removed, or "pickled off", using nitric acid in combination with hydrofluoric acid; or using a combination of hydrogen peroxide, sulfuric acid, and hydrofluoric acid, such as disclosed in U.S. Pat. No. 6,645,306, entitled Hydrogen Peroxide Pickling Scheme for Stainless Steel Grades," issued Nov. 11, 2003, which patent is incorporated by reference herein. Such acids, particularly hydrofluoric acid, are expensive. Further, nitric acid is not considered environmentally friendly.

The present application describes a process for pickling stainless steel by preparing a mixture of an acid such as sulfuric acid ($H_2SO_4$), an excess of hydrogen peroxide ($H_2O_2$), and at least one electrode set including at least one of a cathode or anode and applying a current to a metal strip (such as a stainless steel strip) running through the mixture. Because of an excess of $H_2O_2$, all ferrous sulfate is converted to ferric sulfate ($Fe_2(SO_4)_3$), which acts as an oxidizing agent itself. The process allows for a reduction of total chemicals consumed in the pickling process from known pickling processes and particularly for a reduction of nitric acid ($HNO_3$) and/or hydrofluoric acid (HF) over known pickling processes. Further, certain ferritic stainless steels can be pickled without including HF in a pickling process utilizing the above disclosed mixture of an acid such as sulfuric acid ($H_2SO_4$), an excess of hydrogen peroxide ($H_2O_2$), and at least one electrode set.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
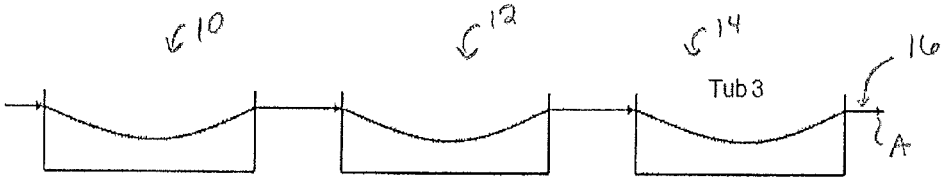
FIG. 1 PRIOR ART
FIG. 1 depicts a schematic of a three tub arrangement of prior art pickling of a stainless steel strip.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples should not be used to limit the scope of the present invention. Other examples, features, aspects, embodiments, and advantages of the new pickling process will become apparent to those skilled in the art from the following description. As will be realized, the invention is capable of other different and obvious aspects, all without departing from the invention. Accordingly, the drawings and descriptions should be regarded as illustrative in nature and not restrictive.

The present disclosure relates to a process for pickling metal, and in particular to pickling a hot rolled, hot rolled and annealed, or cold rolled and annealed stainless steel strip that is processed in a continuous fashion. The process comprises at least one pickling tank and optionally may include at least one of a pre-pickling tank, a scrubber-brush tank, a de-smutting tank, a filtration unit, or a heat exchanger. For example, the process may comprise a series of pre-pickling steps that are mechanical and/or chemical, one or more pickling tanks, and a post-treatment step to rinse and dry the treated material, all of which are known in the art. A pre-treatment step may include, for example, shot blasting, stretch leveling, a molten bath exposure, or a suitable pre-treatment step as will be apparent to one of ordinary skill in the art in view of the teachings herein. Such pre-treatment steps mechanically crack and/or remove scale and/or chemically reduce a scale layer on a metal strip to prepare the metal strip for more efficient pickling.

The nature of the oxides and the treatments to remove them from the base metal are dependent on the alloy composition of the base metal. Stainless steels are rich in chromium (Cr) and when heated they form oxides rich in Cr. The Cr rich oxides are relatively resistant/passive to attack by most acids. They typically require use of a combination of acids such as nitric acid ($HNO_3$) and hydrofluoric acid (HF) to completely remove them. A function of HF is to penetrate the protective Cr rich oxide and then allow for oxidizing acids such as $HNO_3$ to dissolve Cr depleted base metal and prevent premature passivation of the base metal before the oxide layer is fully removed. HF is an expensive chemical and $HNO_3$ tends to be disfavored because of environmental concerns.

The described process reduces the concentrations of acids, particularly $HNO_3$ and/or HF required without negative impact on production rates by using the additional pickling power of at least one electrode set having a least one cathode and at least one anode, an excess of an oxidizing agent such as $H_2O_2$. The excess of the oxidizing agent creates another oxidizing agent, and the power of the another oxidizing agent, such as $Fe_2(SO_4)_3$, acts to aggressively attack the rich oxide and thus release/lift the oxide from the base metal. The process allows for a reduction of total chemicals consumed in the pickling process from known pickling processes and for a reduction of nitric acid ($HNO_3$) and/or hydrofluoric acid (HF) over known pickling processes.

In known pickling methods, hot rolled metal material, hot rolled and annealed metal material, and/or cold rolled and annealed metal material such as a stainless steel strip are processed in a combination of mixed acids and are exposed to a series of pickling tanks or tubs. In one known process, a first tank may include sulfuric acid ($H_2SO_4$) and HF. A second tank may include $HNO_3$ and HF. A final tank may include $HNO_3$ to passivate the surface of the metal strip, which is then rinsed and dried. FIG. 1 shows a known prior art pickling method having three tanks. First tank 10 includes $H_2SO_4$ and may additionally include HF. Second tank 12 includes $HNO_3$ and HF. Third tank 14 includes $HNO_3$. Stainless steel strip 16 passes in a continuous manner through each of first tank 10, second tank 12, and third tank 14 in the direction of arrow A.

A process is disclosed that can reduce or eliminate the need for the $HNO_3$ and HF bath in the second tank for ferritic stainless steels and reduces the concentrations needed in such a $HNO_3$ and HF bath for austenitic and martensitic stainless steels.

The disclosed process follows the pre-treatment step(s) described above. After the pre-treatment step(s), the metal strip is immersed in a first electrolytic pickling bath comprising an acidic composition and an oxidizing agent. The acidic environment may include $H_2SO_4$, for example, and may additionally include HF. Certain ferritic stainless steels will not require HF in this step of the process. One of the oxidizing agents may be, for example, ferric sulfate ($Fe_2(SO_4)_3$), which can be created by continuously injecting another oxidizing agent such hydrogen peroxide ($H_2O_2$), and the $H_2O_2$ may be kept in excess to the dissolved metals such that $H_2O_2$ would exist at a concentration above what is necessary to convert all ferrous metal to ferric metal. For example, as the scale of oxides on a steel strip is dissolved by a pickling process, ferrous metals dissolve into the pickling mixture as ferrous sulfate. The ferrous sulfate slows the chemical reaction associated with a pickling rate. Ferrous sulfate is able to be converted to ferric sulfate via an oxidizing agent such as $H_2O_2$ or $HNO_3$, for example. Ferric sulfate advantageously acts as an accelerator to the chemical pickling reaction rate. An excess amount of $H_2O_2$ ensures that a full conversion of ferrous sulfate to ferric sulfate has been made.

Electrodes are used to apply a current to the metal strip while the strip is immersed within this bath. An electrode set may include at least one of a cathode or an anode, where a steel strip may act as the other of a cathode or an anode to conduct current. For example, in a batch pickling process, steel wire coils, or steel parts, are submerged as a discrete unit, rather than a continuous strip, into a batch containing a pickling mixture. In such an instance, a cathode may be present in the mixture and the steel part may act as an anode. Additionally or alternatively, for either a batch process or a continuous process, at least one cathode and at least one anode electrode set may be used, for example. The arrangement may be a cathode-anode-cathode electrode set arrangement, though other electrode set arrangements as will be apparent to one of ordinary skill in the art in view of the teachings herein may additionally or alternatively be used. For example, a single electrode set including one cathode and one anode may be used. With the electrolytic pickling bath described above, the control of the ratio of ferric to ferrous ions in the pickling bath is not required.

Use of such a solution as the first pickling bath described above advantageously de-scales most ferritic stainless steels and significantly reduces a scale layer for austenitic stainless steels that may then need a second pickling bath containing reduced concentrations of acids such as $HNO_3$ and/or HF, to sufficiently remove any remaining oxide/scale layer. While the disclosed process does not require a third $HNO_3$ bath to obtain a cleaned and pickled metal strip on ferritic stainless steels, such a third bath may be used to passivate a surface of the treated metal strip.

Figure 2:
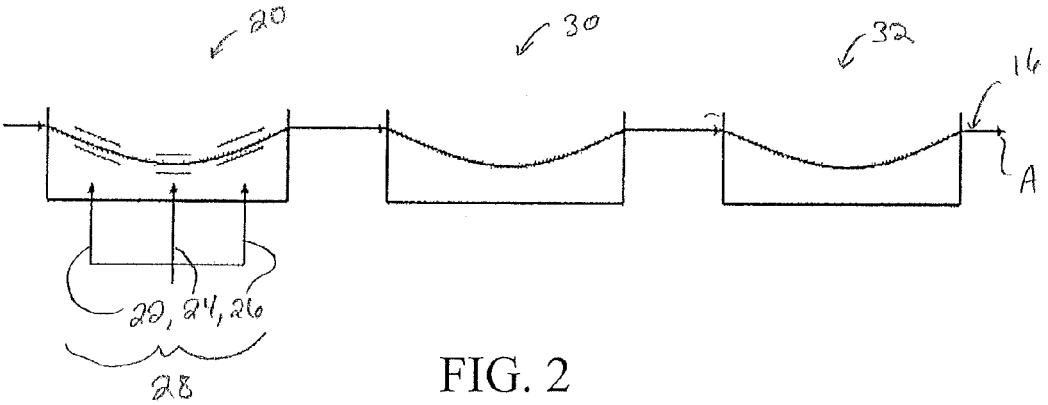
FIG. 2 depicts a schematic for a three tub arrangement of pickling of a steel strip wherein the first tub includes a cathode-anode-cathode electrode set.

FIG. 2 shows an example of the disclosed process using an electrolytic pickling bath after annealing and the molten salt treating of a steel strip 16. First tank 20 includes a $H_2SO_4$ and HF bath having electrode sets 22, 24, and 26 organized as arrangement 28 through which stainless steel strip 16 runs in a continuous fashion and in the direction of arrow A. First tank 20 may contain, for example, from about 10 g/L to about 200 g/L of $H_2SO_4$, or about 30 g/L to about 120 g/L of $H_2SO_4$, or about 25 g/L to about 35 g/L of $H_2SO_4$, from about 0 g/L to about 100 g/L of HF, from about 0.01 g/L to about 100 g/L of $H_2O_2$, or about 1 g/L to about 100 g/L of $H_2O_2$, or about 5 g/L to about 100 g/L of $H_2O_2$, and at least one cathode and one anode electrode set. The inclusion of HF in the electrolytic bath would necessitate a special compatible material that is resistant to chemical attack, but is still electrically conductive. Electrode set 22 is a cathode electrode set, electrode set 24 is an anode electrode set, and electrode set 26 is a cathode electrode set. Steel strip 16 runs through arrangement 28 and each set 22, 24, 26 applies current to steel strip 16. Current may be applied, for example, in a range of from about 10 to about 200 Coulombs per $dm^2$ with a current density of from about 1 to about 100 Amps per $dm^2$ or from about 1 to about 10 Amps per $dm^2$. A temperature of from about 70° F. to about 180° F. or from about 80° F. to about 130° F. may be maintained to manage breakdown of $H_2O_2$ when injected into the system. An amount of dissolved metals could be equal to or less than about 80 g/L, in the range of from about 0 to 80 g/L, or in a range of from about 5 to about 40 g/L.

Second tank 30 includes $HNO_3$ for use, for example, with ferritic stainless steel processing. Second tank 30 may contain, for example, from about 10 g/L to about 130 g/L of $HNO_3$. A second tank is optional for ferritic stainless steel processing unless it is desired to brighten and passivate the steel strip via the pickling process rather than via a later, natural reaction with air, at which point the second tank would be necessary. For austenitic stainless steel grades, a second tank may contain a total amount of $HNO_3$ and HF reduced from that used in known pickling processes. For example, as described below with respect to Example 1, HF may be reduced by about 50% from a known process such that a total consumption of $HNO_3$ and HF is reduced in the second tank. The HF may be included in the concentration of, for example, from about 1 g/L to about 100 g/L or about 5 g/L to about 30 g/L or about 5 g/L to about 25 g/L. Third tank 32 may include $HNO_3$ for use, for example, with ferritic stainless steel processing, or may utilize HF for use, for example, with austentic stainless steel processing. Third tank 32 may contain, for example, from about 10 g/L to about 130 g/L of $HNO_3$. The HF may be included in third tank 32 in the concentration of, for example, from about 1 g/L to about 100 g/L or about 5 g/L to about 30 g/L or about 5 g/L to about 25 g/L. Or the third tank 32 may include no HF and an amount of $HNO_3$ that is reduced by about 20% from a known process such that a total consumption of acids is reduced over that of prior art processes in the third tank.

Figure 3:
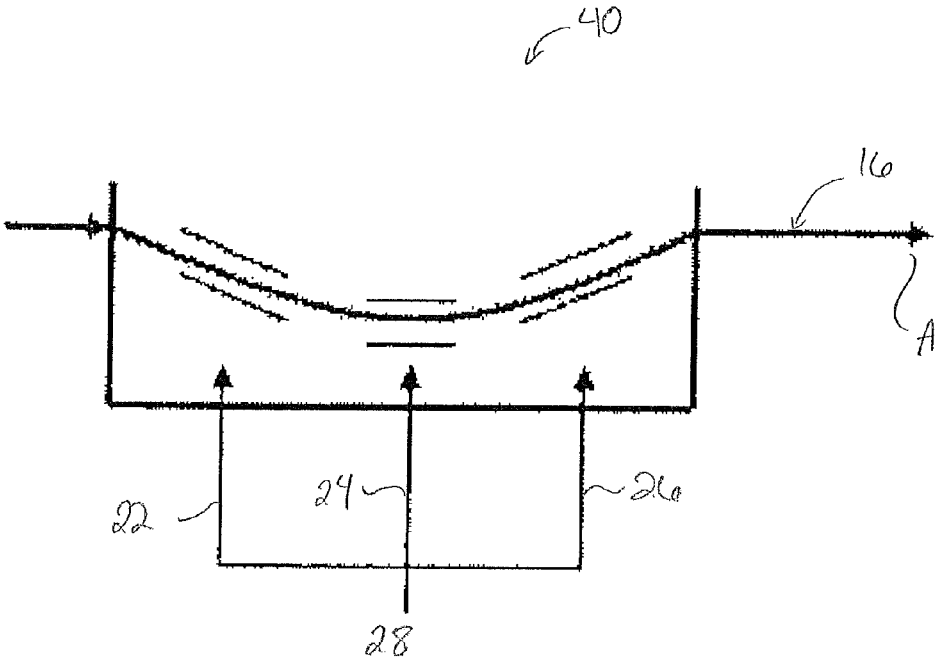
FIG. 3 depicts a schematic for a one tub, electrolytic arrangement of pickling of a stainless steel strip.

The process of the present application may alternatively only use a single tank, which is shown in FIG. 3 as single tank 40. Such a single tank process may be used particularly for steel strip 16 that is a ferritic stainless steel. Tank 40 includes the bath solution described above for first tank 20 of FIG. 2. After leaving tank 40, steel strip 16 proceeds to a rinsing and drying treatment section as will be apparent to one of ordinary skill in the art in view of the teachings herein.

EXAMPLES

In the following examples the polarity of the electrolyte was switched at least one time in a manner apparent to one of ordinary skill in the art in view of the teachings herein.

Example 1

In the first example showing actual data, the electrolytic pickling ("EP") process of the present disclosure was found to consume less total chemicals and operate at a lower temperature while arriving at better results than a pickling process of the prior art (referred to as "Baseline" below).

TABLE 1

| TUB 1 | | | | | | |
|---|---|---|---|---|---|---|
| | EP 301 SS | EP 304 SS | EP 316 SS | Baseline 301 SS | Baseline 304 SS | Baseline 316 SS |
| $H_2SO_4$ (g/L) | 30 | 30 | 30 | 100 | 100 | 100 |
| $Fe^{3+}$ (g/L) | 30 | 30 | 30 | 0 | 0 | 0 |
| $Fe^{2+}$ (g/L) | 0 | 0 | 0 | 30 | 30 | 30 |
| $H_2O_2$ (g/L)* | >0.1 | >0.1 | >0.1 | 0 | 0 | 0 |
| C/dm$^2$ | 100 | 100 | 100 | 30 | 30 | 30 |
| Temp (F.) | 120 | 120 | 120 | 160 | 160 | 160 |
| Visual Appearance | Almost Clean | Almost Clean | Same as original | Half Clean | Half Clean | Same as original |

*H2O2 was not measured in this case, but was theoretically calculated based on the known chemical reaction.

Stainless steels of ASTM grades 301, 304, and 316, which grades and associated chemical compositions are known in the art, were tested in both the Baseline process and the EP process. For the Baseline process, a remaining amount of 30 g/L of $Fe^{2+}$ showed that $H_2O_2$ is not in excess (as does the 0 g/L amount of $H_2O_2$). For the EP process, an amount of 0 g/L of $Fe^{2+}$ showed that $H_2O_2$ is in excess (also as shown by the 5 g/L amount of $H_2O_2$). For the grade 301 stainless steel, the Baseline process used a first tub having 100 g/L of $H_2SO_4$ and 30 Coulombs/dm$^2$ at a temperature of 160 degrees Fahrenheit, which resulted in a partially cleaned steel surface. The EP process used a first tub having a reduced amount of 30 g/L of $H_2SO_4$, 30 g/L of $Fe^{3+}$, and an increased 100 Coulombs/dm$^2$ at a reduced temperature of 120 degrees Fahrenheit, which resulted in a substantially fully cleaned steel surface. Similar amounts for the grade 304 stainless steel produced equivalent results. Similar amounts for the grade 316 stainless steel produced results in which the steel surface appeared to be the same as prior to the pickling process, which indicated an unsuccessful cleaning The materials of this first example may then be fully cleaned in one or more subsequent tubs that included reduced amounts of $HNO_3$ and HF in comparison to subsequent tubs used in known pickling processes. "Total HF" is described in the following examples and it is the combination of "free HF" and the portion bound to dissolved metals. Depending on the analysis technique, "total HF" or "free HF" can be measured.

To completely clean the material, subsequent pickling would be expected at the following concentrations for each of tubs 2 and 3 below. The term clean indicates a generally acceptable appearance from a production standpoint as apparent to one of ordinary skill in the art.

TABLE 2

| TUB 2 | | | | | | |
|---|---|---|---|---|---|---|
| | EP 301 SS | EP 304 SS | EP 316 SS | Baseline 301 SS | Baseline 304 SS | Baseline 316 SS |
| $HNO_3$ (g/L) | 100 | 100 | 100 | 100 | 100 | 100 |
| Total HF (g/L) | 10 | 10 | 20 | 20 | 20 | 40 |
| $Fe^{3+}$ (g/L) | 30 | 30 | 30 | 30 | 30 | 30 |
| Temp (F.) | 130 | 130 | 130 | 130 | 130 | 150 |

TABLE 3

| TUB 3 | | | | | | |
|---|---|---|---|---|---|---|
| | EP 301 SS | EP 304 SS | EP 316 SS | Baseline 301 SS | Baseline 304 SS | Baseline 316 SS |
| $HNO_3$ (g/L) | 80 | 80 | 80 | 100 | 100 | 100 |
| Total HF (g/L) | 0 | 0 | 0 | 5 | 5 | 5 |
| $Fe^{3+}$ (g/L) | 20 | 20 | 20 | 20 | 20 | 20 |
| Temp (F.) | 130 | 130 | 130 | 130 | 130 | 130 |
| Appearance | Clean | Clean | Clean | Clean | Clean | Clean |

In the EP process disclosed in the first example, the HF consumed was reduced by more than half of that consumed in the Baseline process in the second tub and removed completely from the mixture in the third tub. The HNO3 concentration could have been be cut by about 20% in the second tub.

Example 2

The following second example is proposed if compatible materials are made for the electrodes. In the second example, a two tub EP process is used where the second tub solely contains $HNO_3$, and results in a substantially cleaned stainless steel surface. Because no HF is used in the second tub, a reduction in a total consumption of acids occurs from a known process that is known to utilize both $HNO_3$ and HF in a second tub. As the grade 316 stainless steel is more difficult to pickle, the addition of HF into the second tub is an option.

TABLE 4

| TUB 1 | | | | |
|---|---|---|---|---|
| | EP 409 SS | EP 301 SS | EP 304 SS | EP 316 SS |
| $H_2SO_4$ (g/L) | 30 | 30 | 30 | 30 |
| Total HF (g/L) | 5 | 10 | 10 | 20 |
| $Fe^{3+}$ (g/L) | 30 | 30 | 30 | 30 |

TABLE 4-continued

| TUB 1 | EP 409 SS | EP 301 SS | EP 304 SS | EP 316 SS |
|---|---|---|---|---|
| $Fe^{2+}$ (g/L) | 0 | 0 | 0 | 0 |
| C/dm$^2$ | 50 | 100 | 100 | 120 |
| Temp (F.) | 120 | 120 | 120 | 120 |
| Expected Results | Clean | Clean | Clean | Half Clean |

For each of the tested grades (301, 304, 316, and 409), 30 g/L of $H_2SO_4$ and 30 g/L of $Fe^{3+}$ are used at a temperature of 120 degrees Fahrenheit. For grade 316 stainless steel, a difficult grade to pickle, 20 g/L of HF and 120 Coulombs/dm$^2$ are used. For grades 301 and 304 stainless steel, 10 g/L HF and 100 Coulombs/dm$^2$ are used. For grade 409 stainless steel, an easier grade to pickle, 5 g/L of HF and 50 Coulombs/dm$^2$ are used. To substantially and further completely clean the steel strips of the second example, the second and/or third tubs could include a reduced amount of HF from known pickling processes. For example, the 409 grade stainless steel could eliminate the use of HF in one or more subsequent tubs. The 301 grade stainless steel and the 304 grade stainless steel would utilize between about 0 g/L to about 10 g/L of HF, and the 316 grade stainless steel would utilize about 10 g/L to about 30 g/L of HF. This concentration would have been a reduction of about 20% to about 50% for these grades of stainless steel over known pickling processes.

Example 3

The third example shown below and derived from actual data highlights that the

EP process permits for a reduction in total chemicals used. Here, sodium sulfate ($Na_2SO_4$) was used in a baseline case and grade 304 and grade 409 stainless steels were tested under the baseline process and the EP process.

TABLE 5

| TUBS 1-3 | | 409 (baseline) | 409 (EP) | 304 (baseline) | 304 (EP) |
|---|---|---|---|---|---|
| Tub 1 | $Na_2SO_4$ (g/L) | 175 | — | 175 | — |
| | $H_2SO_4$ (g/L) | pH = ~3-5 | 30 | pH = ~3-5 | 30 |
| | $Fe^{3+}$ (g/L) | 1-2 | 30 | 1-2 | 30 |
| | $Fe^{2+}$ (g/L) | 1-2 | 0 | 1-2 | 0 |
| | $H_2O_2$ (g/L)* | 0 | 5 | 0 | 5 |
| | C/dm2 | 60 | 120 | 120 | 120 |
| | Temp (F.) | 150 | 120 | 150 | 120 |
| Tub 2 | $HNO_3$ (g/L) | 105 | 105 | 120 | 120 |
| | Total HF (g/L) | 8 | 8 | 42.3 | 42.3 |
| | $Fe^{3+}$ (g/L) | 32.5 | 32.5 | 27.5 | 27.5 |
| | Temp (F.) | 125 | 125 | 130 | 130 |
| Tub 3 | $HNO_3$ (g/L) | 120 | 105 | 120 | 120 |
| | Total HF (g/L) | 22.5 | 8 | 42.3 | 42.3 |
| | $Fe^{3+}$ (g/L) | 27.5 | 27.5 | 27.5 | 27.5 |
| | Temp (F.) | 125 | 125 | 130 | 130 |
| | Appearance | Clean | Clean | Clean | Clean |

*$H_2O_2$ was not measured in this case, but was theoretically calculated based on the known chemical reaction.

Notable for tubs 2 and 3, $HNO_3$ acts as an oxidizing agent that allows for a complete conversion of ferrous ions to ferric ions. For the grade 304 stainless steel, the baseline process used 175 g/L of $Na_2SO_4$, 1-2 g/L of $Fe^{3+}$, 1-2 g/L of $Fe^{2+}$, 0 g/L of $H_2O_2$, 120 Coulombs/dm$^2$ and was kept at a temperature of 150 degrees Fahrenheit in the first tub. The second and third tubs each included 120 g/L of $HNO_3$, 42.3 g/L of HF, 27.5 g/L of $Fe^{3+}$ at a temperature of 130 degrees Fahrenheit. A final clean appearance was visually obtained.

For the grade 304 stainless steel, the EP process used 30 g/L of $H_2SO_4$, 30 g/L of $Fe^{3+}$, 0 g/L of $Fe^{2+}$, an excess amount of $H_2O_2$ (>0.1 g/L) 120 Coulombs/dm$^2$ and was kept at a reduced temperature of 120 degrees Fahrenheit in the first tub. The second and third tubs each still included 120 g/L of $HNO_3$, 42.3 g/L of HF, 27.5 g/L of $Fe^{3+}$ at a temperature of 130 degrees Fahrenheit. A reduced total amount of chemicals was consumed in the EP process over the baseline process, and a final clean appearance was visually obtained.

For the grade 409 stainless steel, the baseline process used 175 g/L of $Na_2SO_4$, 1-2 g/L of $Fe^{3-}$, 1-2 g/L of $Fe^{2+}$, 0 g/L of $H_2O_2$, 60 Coulombs/dm$^2$ and was kept at a temperature of 150 degrees Fahrenheit in the first tub. The second tub included 105 g/L of $HNO_3$, 8 g/L of HF, 32.5 g/L of $Fe^{3+}$ at a temperature of 125 degrees Fahrenheit. The third tub included 120 g/L of $HNO_3$, 22.5 g/L of HF, 27.5 g/L of $Fe^{3+}$ at a temperature of 125 degrees Fahrenheit. A final clean appearance was visually obtained.

For the grade 409 stainless steel, the EP process used 30 g/L of $H_2SO_4$, 30 g/L of $Fe^{3+}$, 0 g/L of $Fe^{2+}$, 5 g/L of $H_2O_2$, and 120 Coulombs/dm$^2$ and was kept at a reduced temperature of 120 degrees Fahrenheit in the first tub. The second tub included 105 g/L of $HNO_3$, 8 g/L of HF, 32.5 g/L of $Fe^{3+}$ at a temperature of 125 degrees Fahrenheit. The third tub included, at a temperature of 125 degrees Fahrenheit, 27.5 g/L of $Fe^{3+}$ and reduced amounts of 105 g/L of $HNO_3$ and 8 g/L of HF. A reduced total amount of acids were consumed in the EP process over the baseline process. For example, in the third tub of the EP process, $HNO_3$ was reduced by 15 g/L over the concentration used in the third tub of the baseline process, and HF was reduced by 14.5 g/L over the concentration used in the third tub of the baseline process. This resulted in a total reduced concentration of 29.5 g/L of acids used in the third tub of the EP process over the total concentration of acids used in the baseline process. Further, a final clean appearance was visually obtained.

Example 4

A fourth example shown below highlights that the EP process permits for a reduction in the expected concentration of the chemicals used. Here, sodium sulfate ($Na_2SO_4$) is used in a baseline case and grade 304 and grade 409 stainless steels are tested under the baseline process and the EP process.

TABLE 6

| TUBS 1-3 | | 409 (baseline) | 409 (EP) | 304 (baseline) | 304 (EP) |
|---|---|---|---|---|---|
| Tub 1 | $Na_2SO_4$ (g/L) | 175 | — | 175 | — |
| | $H_2SO_4$ (g/L) | pH = ~3-5 | 30 | pH = ~3-5 | 30 |
| | $Fe^{3+}$ (g/L) | 1-2 | 30 | 1-2 | 40 |
| | $Fe^{2+}$ (g/L) | 1-2 | 0 | 1-2 | 0 |
| | $H_2O_2$ (g/L)* | 0 | 5 | 0 | 5 |
| | C/dm2 | 60 | 120 | 120 | 120 |
| | Temp (F.) | 150 | 120 | 150 | 120 |
| Tub 2 | $HNO_3$ (g/L) | 120 | 100 | 120 | 100 |
| | Total HF (g/L) | 20 | 0 | 40 | 20 |

TABLE 6-continued

| TUBS 1-3 | | 409 (baseline) | 409 (EP) | 304 (baseline) | 304 (EP) |
|---|---|---|---|---|---|
| Tub 3 | $Fe^{3+}$ (g/L)* | 30 | 30 | 30 | 30 |
| | Temp (F.) | 120 | 120 | 130 | 130 |
| | $HNO_3$ (g/L) | 80 | 80 | 100 | 80 |
| | Total HF (g/L) | 5 | 0 | 20 | 10 |
| | $Fe^{3+}$ (g/L)* | 20 | 20 | 20 | 20 |
| | Temp (F.) | 120 | 120 | 130 | 130 |

*$H_2O_2$ would not be measured in this case, but would be theoretically calculated based on the known chemical reaction.

For the grade 304 stainless steel, the baseline process uses 175 g/L of $Na_2SO_4$, 1-2 g/L of $Fe^{3+}$, 1-2 g/L of $Fe^{2-}$, 0 g/L of $H_2O_2$, 120 Coulombs/$dm^2$ and is kept at a temperature of 150 degrees Fahrenheit in the first tub. The second tub includes 120 g/L of $HNO_3$, 40 g/L of HF, 30 g/L of $Fe^{3|}$ at a temperature of 130 degrees Fahrenheit and the third tub includes 100 g/L of $HNO_3$, 20 g/L of HF, 20 g/L of $Fe^{3+}$ at a temperature of 130 degrees Fahrenheit. A final clean appearance is expected to be visually obtained.

For the grade 304 stainless steel, the EP process uses 30 g/L of $H_2SO_4$, 40 g/L of $Fe^{3+}$, 0 g/L of $Fe^{2-}$, an excess of $H_2O_2$ (>0.1 g/L), 120 Coulombs/$dm^2$ and is kept at a reduced temperature of 120 degrees Fahrenheit in the first tub. The second tub includes 100 g/L of $HNO_3$, 20 g/L of HF, 30 g/L of $Fe^{3+}$ at a temperature of 130 degrees Fahrenheit and the third tub includes 80 g/L of $HNO_3$, 10 g/L of HF, 20 g/L of $Fe^{3+}$ at a temperature of 130 degrees Fahrenheit. A reduced total amount of acids is consumed in the EP process over the baseline process, as well as a reduction of each of $HNO_3$ and HF in the second and third tubs. For example, in the second tub of the EP process, $HNO_3$ was reduced by 20 g/L over the concentration used in the second tub of the baseline process, and HF was reduced by 10 g/L over the concentration used in the second tub of the baseline process. This resulted in a total reduced concentration of 30 g/L of acids used in the second tub of the EP process over the total concentration of acids used in the baseline process. Further, in the third tub of the EP process, $HNO_3$ was reduced by 20 g/L over the concentration used in the third tub of the baseline process, and HF was reduced by 5 g/L over the concentration used in the third tub of the baseline process. This resulted in a total reduced concentration of 25 g/L of acids used in the third tub of the EP process over the total concentration of acids used in the baseline process. A final clean appearance is expected to be visually obtained.

For the grade 409 stainless steel, the baseline process uses 175 g/L of $Na_2SO_4$, 0 g/L of $Fe^{3+}$, 40 g/L of $Fe^{2+}$, 0 g/L of $H_2O_2$, 60 Coulombs/$dm^2$ and is kept at a temperature of 150 degrees Fahrenheit in the first tub. The second tub includes 120 g/L of $HNO_3$, 20 g/L of HF, 30 g/L of $Fe^{3+}$ at a temperature of 120 degrees Fahrenheit. The third tub includes 80 g/L of $HNO_3$, 5 g/L of HF, 20 g/L of $Fe^{3+}$ at a temperature of 120 degrees Fahrenheit. A final clean appearance is expected to be visually obtained.

For the grade 409 stainless steel, the EP process uses 30 g/L of $H_2SO_4$, 30 g/L of $Fe^{3+}$, 0 g/L of $Fe^{2-}$, 5 g/L of $H_2O_2$, and 120 Coulombs/$dm^2$ and is kept at a reduced temperature of 120 degrees Fahrenheit in the first tub. The second tub includes 100 g/L of $HNO_3$, 0 g/L of HF, 30 g/L of $Fe^{3+}$ at a temperature of 120 degrees Fahrenheit. The third tub includes, at a temperature of 120 degrees Fahrenheit, 20 g/L of $Fe^{3+}$ and reduced amounts of 80 g/L of $HNO_3$ and 0 g/L of HF. A reduced total amount of acids is consumed in the EP process over the baseline process, as well as a reduction of each of $HNO_3$ and HF in the second tub, and a reduction of HF in the third tub. For example, in the second tub of the EP process, $HNO_3$ was reduced by 20 g/L over the concentration used in the second tub of the baseline process, and HF was reduced by 20 g/L (to 0 g/L) over the concentration used in the second tub of the baseline process. This resulted in a total reduced concentration of 40 g/L of acids used in the second tub of the EP process over the total concentration of acids used in the baseline process. Further, in the third tub of the EP process, HF was reduced by 5 g/L over the concentration used in the third tub of the baseline process. This resulted in a total reduced concentration of 5 g/L of acids used in the third tub of the EP process over the total concentration of acids used in the baseline process. A final clean appearance is expected to be visually obtained.

Thus, for the 409 grade stainless steel with the EP process, 100% of the HF may be eliminated. For other ferritic grades and the lower alloyed austenitic grades, like 301 grade stainless steel and 304 grade stainless steel, HF concentration is able to be reduced by 20% or more over baselines processes. For 316 austenitic grade stainless steel, a substantial reduction may not occur. In some cases, the concentration of $HNO_3$ may be able to be reduced in an EP process by 10-20% over a baseline process.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative. Accordingly, the scope of the present invention should be considered in terms of the following claims and is understood not to be limited to the details of structure and operation shown and described in the specification and drawings.

We claim:

1. A process for pickling a strip of ferritic stainless steel consisting of:

treating the steel with a first mixture disposed in a first tub, the first mixture consisting of $H_2SO_4$, and an oxidizing agent selected from a group consisting of $H_2O_2$ and $HNO_3$, wherein the step of treating the steel with the first mixture consists of reacting the first mixture with the steel, wherein reaction of the first mixture with the steel produces a concentration of ferrous sulfate, wherein said oxidizing agent is in excess relative to the ferrous sulfate so as to convert the ferrous sulfate to ferric sulfate ($Fe_2(SO_4)_3$) resulting in a concentration of $Fe_2(SO_4)_3$, and applying a current to the steel while the steel is in the first tub, wherein the first mixture does not include HF.

2. The process of claim 1, wherein the concentration of $Fe_2(SO_4)_3$ is from about 5 g/L to about 100 g/L.

3. The process of claim 1, wherein the oxidizing agent is $H_2O_2$.

4. The process of claim 1, wherein the concentration of $H_2SO_4$ is from about 10 g/L to about 200 g/L.

5. The process of claim 1, wherein the first tub is a sole tub used in the pickling process.

6. The process of claim 1, wherein the steel is pickled in a continuous fashion.

7. The process of claim 1, wherein the step of applying a current to the steel consists of applying a current via at least one of a cathode or anode.

8. The process of claim 1, wherein the oxidizing agent is $HNO_3$.

9. The process of claim 7, wherein the steel consists of one of the cathode or anode.

10. A process for pickling a continuous strip of stainless steel consisting of:

treating the steel with a first mixture disposed in a first tub, the first mixture consisting of a concentration of $H_2SO_4$, an oxidizing agent selected from a group consisting of $H_2O_2$ and $HNO_3$, and optionally a concentration of HF, wherein the step of treating the steel with the first mixture consists of reacting the first mixture with the steel, wherein reaction of the first mixture with the steel produces a concentration of ferrous sulfate, wherein said oxidizing agent consists of an excessive concentration relative to the ferrous sulfate so as to convert a total amount of the ferrous sulfate to ferric sulfate ($Fe_2(SO_4)_3$) resulting in a concentration of $Fe_2(SO_4)_3$, and applying a current to the steel, wherein a concentration of $H_2SO_4$ is from about 10 g/L to about 200 g/L; and optionally, treating the steel with a second composition disposed in a second tub, wherein second composition consists of about 10 g/L to about 130 g/L $HNO_3$ or about 10 g/L to about 130 g/L $HNO_3$ and HF; and optionally, treating the steel with a third mixture disposed in a third tub, wherein the third mixture consists of $HNO_3$, and wherein a concentration of $HNO_3$ is from about 10 g/L to about 130 g/L.

11. The process of claim 10, wherein the concentration of $Fe_2(SO_4)_3$ is from about 5 g/L to about 100 g/L.

12. The process of claim 10, wherein the oxidizing agent is $H_2O_2$.

13. The process of claim 10, wherein the first mixture further consists of a concentration of HF.

14. The process of claim 10, wherein the step of applying a current to the steel consists of applying a current via at least one of a cathode or anode.

15. The process of claim 10, further consisting of treating the steel with the second composition disposed in the second tub, wherein the second composition consists of about 10 g/L to about 130 g/L $HNO_3$ or about 10 g/L to about 130 g/L $HNO_3$ and HF.

16. The process of claim 10, wherein the steel is pickled in a continuous fashion.

17. The process of claim 10, where a temperature of the first mixture is in the range of from about 70° F. to 180° F. or in the range of from about 80° F. to 130° F.

18. The process of claim 10, wherein an amount of total dissolved metals in the first mixture after the first mixture treats the strip is equal to or less than about 80 g/L.

19. The process of claim 10, wherein step of applying a current to the steel consists of applying a current via electrodes that consists of a cathode-anode-cathode arrangement, wherein the electrodes are operable to apply a current in the range of from about 10 Coulombs/$dm^2$ to about 200 Coulombs/$dm^2$ with a current density in the range of from about 1 Amps/$dm^2$ to about 100 Amps/$dm^2$.

20. The process of claim 13, wherein the concentration of $H_2SO_4$ is from about 25 g/L to about 35 g/L, and wherein the concentration of HF in the first mixture is from about greater than 0 g/L to about 100 g/L.

21. The process of claim 14, wherein the steel consists of one of the cathode or anode.

22. The process of claim 15, wherein the first mixture further consists of HF.

23. The process of claim 15, wherein the stainless steel consists of a ferritic stainless steel and the second composition consists of $HNO_3$.

24. The process of claim 15, wherein the stainless steel consists of an austenitic stainless steel and the second composition consists of $HNO_3$ and HF, and wherein the second composition consists of about 5 g/L to about 25 g/L HF.

25. The process of claim 15, further consisting of treating the steel with a third mixture disposed in a third tub, wherein the third mixture consists of $HNO_3$, and wherein a concentration of $HNO_3$ is from about 10 g/L to about 130 g/L.

* * * * *